US011137217B2

(12) United States Patent
O'Boyle

(10) Patent No.: US 11,137,217 B2
(45) Date of Patent: Oct. 5, 2021

(54) ROTOR FOR A ROTARY PRE-HEATER FOR HIGH TEMPERATURE OPERATION

(71) Applicant: Arvos Ljungstrom LLC, Wellsville, NY (US)

(72) Inventor: Jeffrey O'Boyle, Wellsville, NY (US)

(73) Assignee: Arvos Ljungstrom LLC, Wellsville, NY (US)

( * ) Notice: Subject to any disclaimer, the term of this patent is extended or adjusted under 35 U.S.C. 154(b) by 12 days.

(21) Appl. No.: 16/091,288

(22) PCT Filed: Apr. 5, 2017

(86) PCT No.: PCT/US2017/026176

§ 371 (c)(1),
(2) Date: Oct. 4, 2018

(87) PCT Pub. No.: WO2017/176903

PCT Pub. Date: Oct. 12, 2017

(65) Prior Publication Data

US 2019/0154355 A1 May 23, 2019

Related U.S. Application Data

(63) Continuation of application No. 15/091,200, filed on Apr. 5, 2016, now Pat. No. 10,295,272.

(51) Int. Cl.

| | |
|---|---|
| ***F28D 19/04*** | (2006.01) |
| ***F28D 17/02*** | (2006.01) |
| ***F28F 21/04*** | (2006.01) |

(52) U.S. Cl.

CPC ..... *F28D 19/047* (2013.01); *F28D 17/023* (2013.01); *F28D 19/042* (2013.01); (Continued)

(58) Field of Classification Search

CPC .... F28D 19/042; F28D 19/044; F28D 19/047; F28D 17/04; F28D 17/023; F28D 19/048; (Continued)

(56) References Cited

U.S. PATENT DOCUMENTS 3,216,486 A * 11/1965 Hall ..... F28D 19/048 165/9
3,267,562 A 8/1966 Chiang et al.
(Continued)

FOREIGN PATENT DOCUMENTS

CA 2316827 A1 * 7/1999 ..... F24F 3/1423
CA 2379550 A1 * 2/2001 ..... F28D 19/044
(Continued)

OTHER PUBLICATIONS

International Search Report for corresponding PCT Application No. PCT/US2017/026176 dated Jul. 21, 2017, pp. 1-10.

*Primary Examiner* — Len Tran
*Assistant Examiner* — Jenna M Hopkins
(74) *Attorney, Agent, or Firm* — Murtha Cullina LLP

(57) ABSTRACT

A rotor for a high temperature rotary pre-heater includes a hub that has an exterior surface thereon. The rotor includes an annular rim positioned around and coaxially with the hub. The annular rim has an interior surface. A plurality of partitions extend between the hub and the annular rim. Each of the partitions is located in a predetermined circumferential position by one or more alignment features. The exterior surface, the interior surface and/or the partitions have one or more of the alignment features thereon.

19 Claims, 19 Drawing Sheets

(52) U.S. Cl.
CPC ..... *F28D 19/044* (2013.01); *F24F 2203/108* (2013.01); *F24F 2203/1012* (2013.01); *F24F 2203/1072* (2013.01); *F24F 2203/1096* (2013.01); *F28F 21/04* (2013.01); *F28F 2270/00* (2013.01)

(58) Field of Classification Search
CPC ..... F24F 2203/1012; F24F 2203/108; F24F 2203/1096
See application file for complete search history.

(56) References Cited

U.S. PATENT DOCUMENTS 3,382,915 A * 5/1968 Turunen ..... F28D 19/042 165/9
3,391,727 A * 7/1968 Topouzian ..... F28D 19/044 165/9
3,401,741 A * 9/1968 Paluszny ..... F28D 19/048 165/8
3,435,888 A * 4/1969 Hart ..... F28D 19/047 165/9
3,568,759 A * 3/1971 Blech ..... F28D 19/042 165/8
3,710,850 A * 1/1973 Kurschner ..... F28D 19/044 165/9
3,710,851 A * 1/1973 Finnemore ..... F28D 19/044 165/9
3,762,463 A * 10/1973 Sakaki ..... F28D 19/048 165/8
3,766,972 A * 10/1973 Kitano ..... F02C 7/105 165/8
3,774,675 A * 11/1973 Yoshiro ..... F28D 19/048 165/8
3,789,916 A * 2/1974 Lindahl ..... F24F 3/1423 96/125
3,818,978 A * 6/1974 Finnemore ..... F28D 19/044 165/9
3,861,013 A * 1/1975 Kurschner ..... B23P 15/26 29/890.034
3,891,029 A * 6/1975 Mahoney ..... F28D 19/044 165/8
3,915,220 A * 10/1975 Gibson ..... F28D 19/044 165/8
3,939,902 A * 2/1976 Coubrough ..... F28D 19/042 165/8
3,998,266 A * 12/1976 Finnemore ..... F28D 19/044 165/8
4,057,102 A * 11/1977 Guillot ..... F02C 7/105 165/8
4,063,587 A * 12/1977 Stockman ..... F28D 19/042 165/8
4,151,873 A * 5/1979 Lewakowski ..... F28D 19/048 165/8
4,234,038 A * 11/1980 Dravnieks ..... F24F 3/1423 165/10
4,326,835 A * 4/1982 Wertz ..... F01D 5/22 416/193 A
4,328,856 A * 5/1982 Cunningham ..... F28D 19/00 165/8
4,330,029 A * 5/1982 Noll ..... F28D 19/048 165/8
4,337,819 A * 7/1982 Phillips ..... F28D 19/042 165/9
4,405,011 A * 9/1983 Stockman ..... F28D 19/044 165/10
4,418,742 A * 12/1983 Conde ..... F28D 19/044 165/10
4,658,887 A * 4/1987 Matsuhisa ..... F28D 19/042 165/10
4,838,342 A * 6/1989 Goetschius ..... F28D 19/044 165/10
4,984,621 A * 1/1991 Miller ..... F28D 19/044 165/10
5,002,116 A * 3/1991 Hoagland ..... F24F 12/001 165/54
5,119,885 A * 6/1992 Johnson ..... F28D 19/044 165/10
5,336,471 A * 8/1994 Brophy ..... F01N 3/02 165/10
5,454,418 A * 10/1995 Brophy ..... F28D 19/044 165/76
5,456,310 A * 10/1995 Brophy ..... F28D 19/044 165/10
5,513,695 A * 5/1996 Harting ..... F23L 15/02 165/10
5,615,732 A * 4/1997 Brophy ..... F28D 19/044 165/8
5,740,856 A * 4/1998 Ritter ..... F28D 19/044 165/10
5,836,378 A * 11/1998 Brophy ..... F28D 19/044 165/9
5,911,271 A * 6/1999 Fierle ..... F28D 19/047 165/9
5,913,359 A * 6/1999 Milligan ..... F28D 19/047 165/9
6,155,334 A * 12/2000 Steele ..... F24F 3/1423 165/10
6,257,318 B1 * 7/2001 Fierle ..... F23L 15/02 165/10
6,422,299 B1 * 7/2002 Eriksson ..... F28D 19/048 165/10
2001/0026110 A1 * 10/2001 Kurosawa ..... B01D 53/06 310/261.1
2006/0254756 A1 * 11/2006 Kaser ..... F28D 19/044 165/133
2013/0327495 A1 * 12/2013 Hastings ..... F23L 15/02 165/9
2014/0174560 A1 * 6/2014 Hastings ..... F16J 15/16 137/384

FOREIGN PATENT DOCUMENTS

DE 1255683 B * 12/1967 ..... F28D 19/044
DE 2116702 A1 * 11/1971 ..... F28D 19/044
DE 2153486 A1 * 5/1972 ..... F28D 19/044
DE 2443989 A1 * 4/1975 ..... F28F 21/04
DE 2512817 A1 * 10/1975 ..... F28D 19/044
DE 102014114050 A1 * 3/2016 ..... F28F 21/06
EP 2799803 A1 * 11/2014 ..... F28D 19/044
FR 1445227 A * 7/1966 ..... F28D 19/044
GB 863901 A 3/1961
GB 1118925 A * 7/1968 ..... F28D 19/042
JP S54-78956 U 6/1979
JP 58018090 A * 2/1983 ..... F28D 19/044
JP 58210497 A * 12/1983 ..... F28D 19/042
WO WO-9509686 A2 * 4/1995 ..... F24F 3/1423
WO WO-03101589 A1 * 12/2003 ..... B01D 53/06
WO WO-2010050635 A1 * 5/2010 ..... F28D 19/042

* cited by examiner

ROTOR FOR A ROTARY PRE-HEATER FOR HIGH TEMPERATURE OPERATION

CROSS REFERENCE TO RELATED APPLICATIONS

This application is a national stage application of and claims priority to PCT Application No. PCT/US2017/026176, entitled "ROTOR FOR A ROTARY PRE-HEATER FOR HIGH TEMPERATURE OPERATION," filed Apr. 5, 2017, which is a PCT Application of and claims priority to U.S. patent application Ser. No. 15/091,200, entitled "ROTARY PRE-HEATER FOR HIGH TEMPERATURE OPERATION," filed Apr. 5, 2016, the subject matter of both aforementioned applications are hereby incorporated by reference in their entireties.

FIELD OF THE INVENTION

The present invention relates generally to a rotary pre-heater for high temperature operation, and more particularly to a high temperature rotor configuration that can withstand high temperature operation.

BACKGROUND OF THE INVENTION

Rotary regenerative heat exchangers or pre-heaters are commonly used to recover heat from various combustion and chemical reaction processes, including those associated with the production of synthesis gas (also referred to as Syngas). Conventional rotary regenerative heat exchangers have a rotor mounted in a housing that defines an inlet duct and an outlet duct for the flow of heated flue gases through the heat exchanger. The housing further defines another set of inlet ducts and outlet ducts for the flow of gas streams that receive the recovered heat energy. The rotor has radial partitions or diaphragms defining compartments therebetween for supporting baskets or frames to hold heat transfer sheets. Typically, the rotor and baskets are manufactured from metallic materials.

However, in very high temperature applications (e.g., temperatures exceeding 2100 degrees Fahrenheit (1149 degrees Celsius)), for example in Syngas production systems, typical rotary regenerative heat exchangers have insufficient strength and oxidation can occur on the surfaces thereof. As a result, typical rotary regenerative heat exchangers can fail to operate at such high temperatures.

Thus, there is a need for an improved rotary pre-heater that can withstand high temperature operation.

SUMMARY

There is disclosed herein a rotor for a high temperature rotary pre-heater. The rotor includes a hub that has an exterior surface thereon. The rotor includes an annular rim positioned around and coaxially with the hub. The annular rim has an interior surface. A plurality of partitions extend between the hub and the annular rim. Each of the partitions is located in a predetermined circumferential position by one or more alignment features. The exterior surface, the interior surface and/or the partitions have one or more of the alignment features thereon.

The alignment feature on the exterior surface of the hub, the interior surface of the annular rim and/or the partition is one of an axial slot, an arcuate surface, a flattened surface, a pin and/or a key.

In one embodiment, one or more of the partitions is of an arc shaped modular unitary construction.

In one embodiment, a recess extends along one or more exterior edges of the partitions. In one embodiment there is a filler material, such as mortar, disposed in the at least one recess.

In one embodiment, one or more of the partitions includes a plurality of spokes, extending between the hub and the annular rim. Each of the plurality of spokes has a first terminal end and a second terminal end. One or more of the alignment features on the exterior surface of the hub comprises an axially extending first slot. One or more of the alignment features on the interior surface of the annular rim includes an axially extending second slot. The first terminal end is seated in a respective one of the first axially extending slots and the second terminal end is seated in a respective one of the second slots. A first ceramic fiber blanket is disposed between the first terminal end and the respective one of the first slots; and the second terminal end and the respective one of the second slots.

In one embodiment, the ceramic fiber blanket is adhered to the first terminal end and/or the second terminal end with a sacrificial adhesive facilitating the spokes to be keyed into corresponding first and second slots during assembly.

In one embodiment, the hub, the annular rim and/or one or more of the plurality of partitions comprises a ceramic material.

In one embodiment, a channel member is disposed on the terminal end.

There is disclosed herein a rotary pre-heater that includes an annular housing and a hot-end connecting plate that has a first inlet and a first outlet. The hot-end connecting plate is secured to a first axial end of the annular housing. The rotary pre-heater includes a cold-end connecting plate that has a second inlet and a second outlet. The cold-end connecting plate is secured to a second axial end of the annular housing. A rotor is disposed for rotation in the annular housing and between the hot-end connecting plate and the cold-end connecting plate. The rotor includes a cold-end rotor mounted for rotation on a spindle proximate the cold-end connecting plate. The cold-end rotor has a first plurality of flow passages extending therethrough. The rotor includes a hot-end rotor assembly disposed on the cold-end rotor. The hot-end rotor assembly is located proximate the hot-end connecting plate. The hot-end rotor assembly has a second plurality of flow passages extending therethrough. The hot-end rotor includes a hub having an exterior surface thereon; and an annular rim positioned around and coaxially with the hub. The annular rim has an interior surface. The hot-end rotor includes a plurality of partitions extending between the hub and the annular rim. Each of the partitions are located in a predetermined circumferential position by one or more of the alignment features; and the exterior surface, the interior surface and/or the partitions have one or more of the alignment feature thereon.

In one embodiment, the alignment features on the exterior surface of the hub, the interior surface of the annular rim and/or the partition is one of an axial slot, a flattened surface, an arcuate surface, a pin and a key.

In one embodiment, one or more of the flow passages is arc shaped.

In one embodiment, a recess extends along one or more of the exterior edge of the partitions. In one embodiment a filler material is disposed in one or more of the recesses In one embodiment, the partitions include a plurality of spokes that extend between the hub and the annular rim. Each of the plurality of spokes has a first terminal end and a second terminal end. One or more of the alignment features on the exterior surface of the hub includes an axially extending first slot. One or more of the alignment features on the interior surface of the annular rim comprises an axially extending second slot. The first terminal end is seated in a respective one of the first axially extending slots and the second terminal end is seated in a respective one of the second slots. A first ceramic fiber blanket disposed between the first terminal end and the respective one of the first slots; and/or the second terminal end and the respective one of the second slots.

In one embodiment, the ceramic fiber blanket is adhered to the first terminal end and/or the second terminal end with a sacrificial adhesive facilitating the spokes to be keyed into corresponding first and second slots during assembly.

In one embodiment, the hub, the annular rim and one or more of the plurality of partitions is made from a ceramic material.

DETAILED DESCRIPTION

Figure 1:
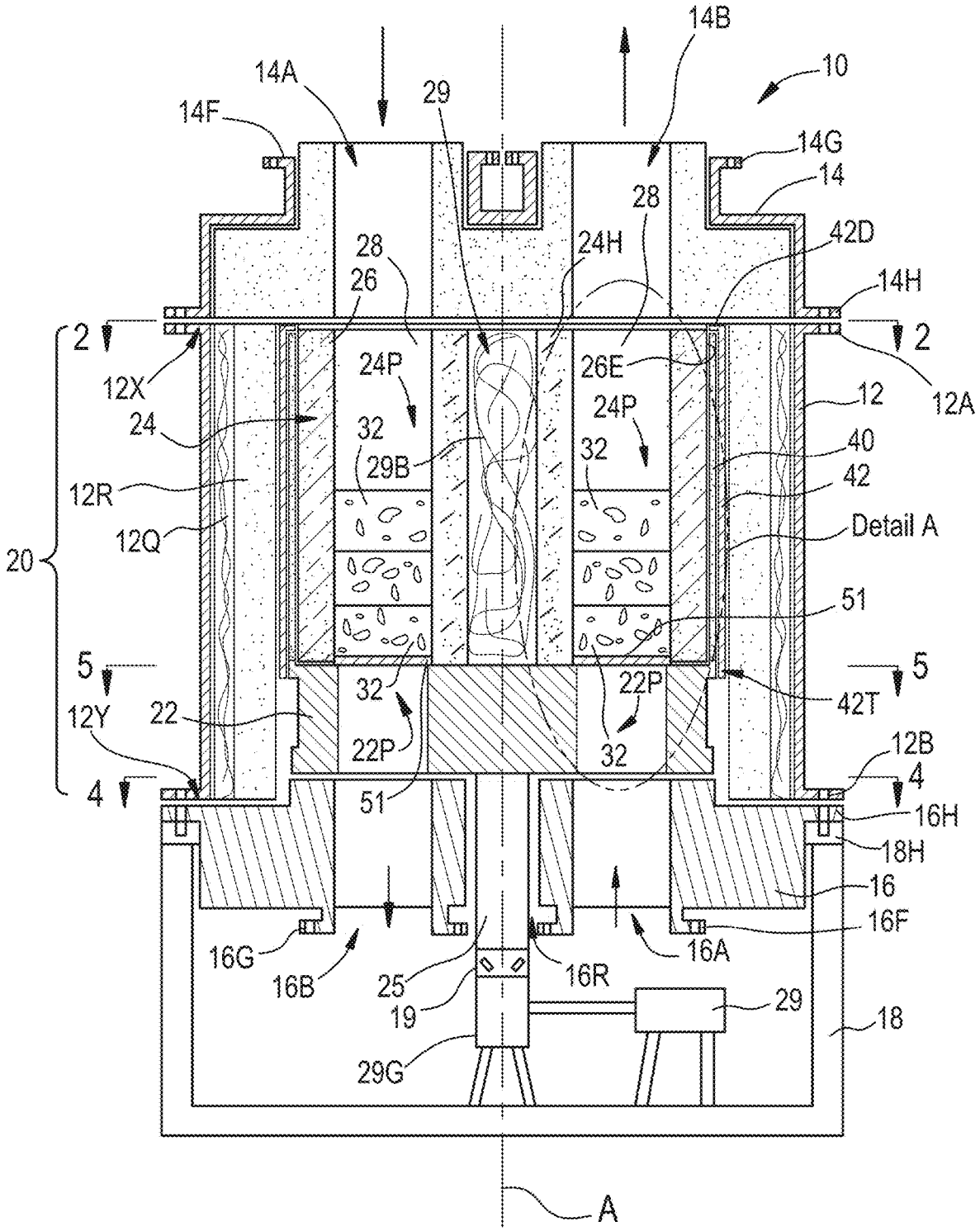
FIG. 1 is a cross sectional view of the rotary pre-heater of the present invention.

As shown in FIG. 1, a rotary pre-heater for high temperature operation is generally designated by the numeral 10. The rotary pre-heater 10 is suitable for use in the production of Syngas, or synthesis gas, which is a fuel gas mixture consisting primarily of hydrogen, carbon monoxide, and some carbon dioxide. The rotary pre-heater 10 has a generally annular housing 12 that extends between a hot-end flange 12A formed at a first axial end 12X of the annular housing 12 and a cold-end flange 12B formed at a second axial end 12Y of the annular housing 12. The annular housing 12 is lined with a suitable refractory 12R (e.g., a ceramic based refractory) wrapped in a ceramic fiber blanket 12Q providing thermal insulation between the refractory 12R and housing 12.

As shown in FIG. 1, the rotary pre-heater 10 includes a hot-end connecting plate 14 having a first inlet 14A defined by a flange 14F and a first outlet 14B defined by a flange 14G. The hot-end connecting plate 14 is associated with a hot side of the rotary pre-heater 10 into which hot gases (e.g., 2100 degrees Fahrenheit (1149 degrees Celsius)) depleted in oxygen flow via the first inlet 14A. The hot-end connecting plate 14 has a flange 14H formed on an axial end thereof, opposite the first inlet 14A and the first outlet 14B. The flange 14H of the hot-end connecting plate 14 is secured to the hot-end flange 12A of the annular housing 12 via suitable fasteners (not shown).

Figure 4:
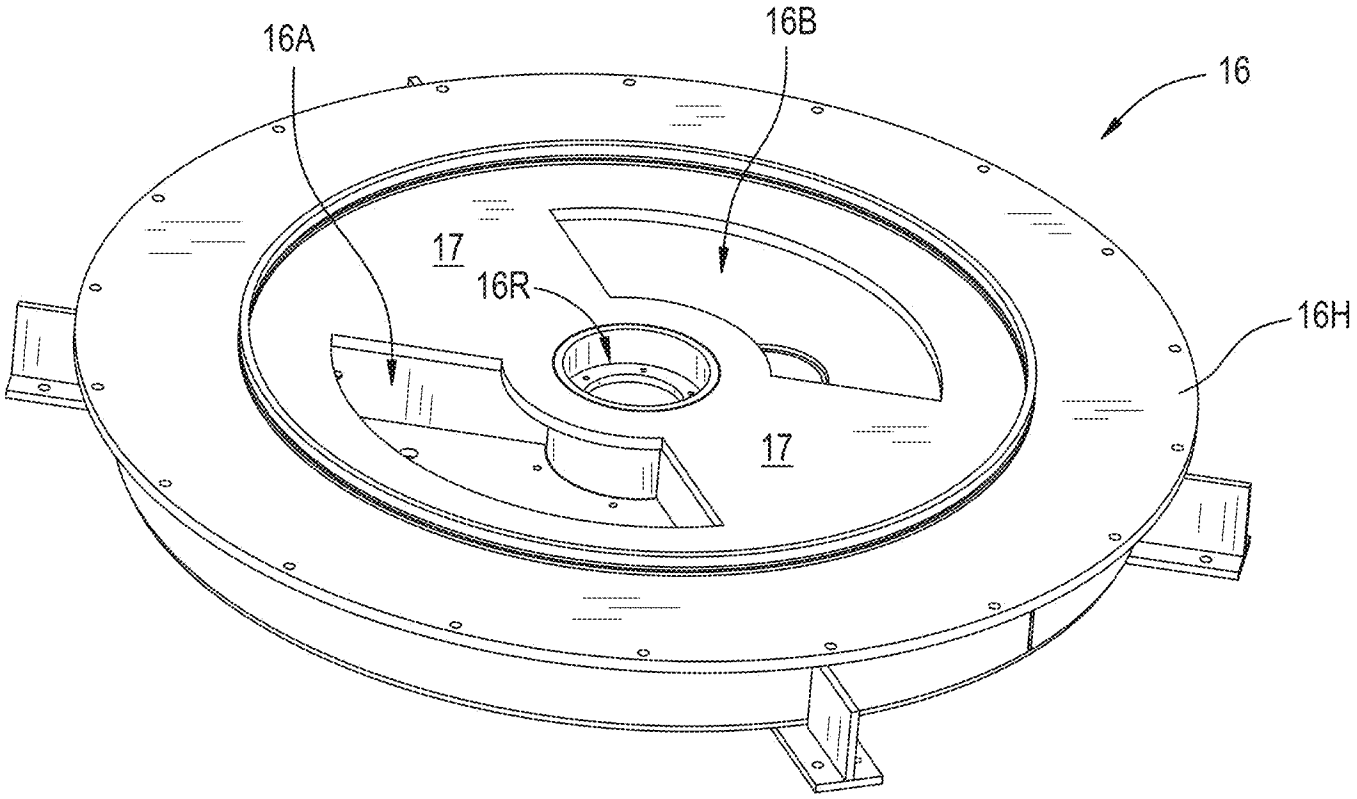
FIG. 4 is a perspective view of the cold-side connecting plate taken across line 4-4 of FIG. 1.

As shown in FIGS. 1 and 4, the rotary pre-heater 10 includes a cold-end connecting plate 16 having a second inlet 16A defined by a flange 16F and a second outlet 16B defined by a flange 16G. The cold-end connecting plate 16 is associated with a cold side of the rotary pre-heater 10 into which cold air to be heated flows via the second inlet 16A. The cold-end connecting plate 16 has a flange 16H formed on an axial end thereof, opposite the second inlet 16A and the second outlet 16B. The flange 16H of the cold-end connecting plate 16 is secured to the flange 12B of the annular housing 12 and a flange 18H of a frame 18 via suitable fasteners (not shown). As shown in FIG. 4, the second inlet 16A of the cold-end connecting plate 16 is an arcuate segment; and the second outlet 16B is another arcuate segment. The arcuate segments define the second inlet 16A and the second outlet 16B which are separated from one another by a flat plate segment 17. The cold-end connecting plate 16 has a centrally located bore 16R extending therethrough for receiving a spindle 25 as described further herein with reference to FIG. 1.

As shown in FIG. 1, a rotor 20 is disposed for rotation in the refractory lined annular housing 12 and axially between the hot-end connecting plate 14 and the cold-end connecting plate 16. The rotor 20 includes a cold-end rotor 22 mounted for rotation on the spindle 25 proximate the cold-end connecting plate 16. The spindle 25 is supported by a suitable bearing 19 (e.g., a tapered thrust bearing). A motor 29 is coupled to a gearbox 29G that is coupled to the spindle 25 for rotation of the rotor 20 relative to the annular housing 12.

Figure 5:
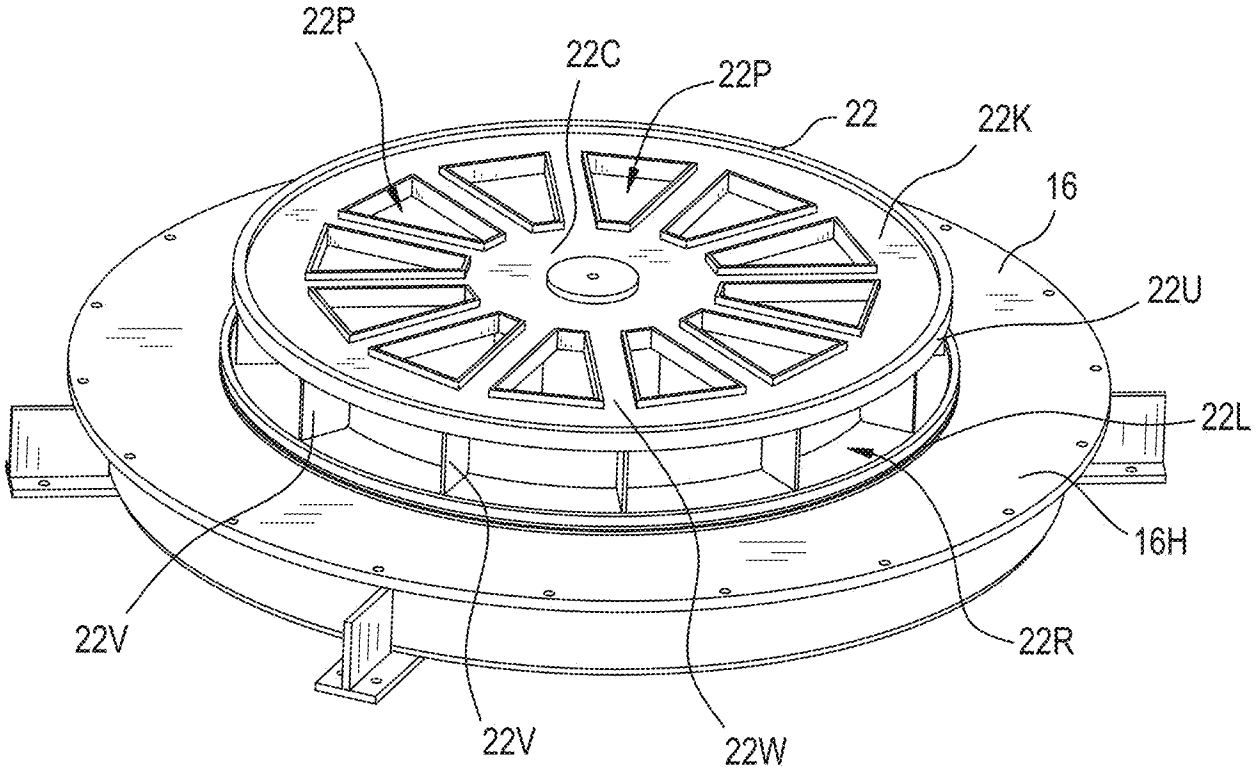
FIG. 5 is a perspective view of the cold-end rotor mounted on the cold side connecting plate taken across line 5-5 of FIG. 1.

As shown in FIGS. 1 and 5, the cold-end rotor 22 has a plurality of first flow passages 22P extending therethrough. Each of the first flow passages 22P has, for example in cross-section a trapezoidal shape and adjacent ones of the first flow passages 22P are separated by an elongate dividing wall 22W that forms along its upper end a first channel. For example, FIG. 5 illustrates twelve of the first flow passages 22P. The first flow passages 22P are smaller than the flat plate segment 17 of the cold-end connecting plate 16 to ensure isolation between the second flow inlet 16A and the second flow outlet 16B as the cold-end rotor 22 rotates relative to the cold-end connecting plate 16. The cold-end rotor 22 has a second channel 22K configured as an annular shape and extending around the periphery of the first flow passages 22P. The cold-end rotor 22 has a third channel 22C configured as an annular shape and extending radially inwardly of the first flow passages 22P. The second channel 22K and third channel 22C are concentric and coaxial with the cold-end rotor 22 and the spindle 25. The first channels each associated with and atop a respective one of the dividing walls 22W, the second channel 22K and the third channel 22C interconnect and communicate with one another and are configured in a hub, spoke and wheel socket configuration complementary to and mating with a hot-end rotor 24 as described further herein. The hub, spoke and wheel socket configuration increases the strength of the hot-end rotor assembly 24 at elevated temperatures (e.g., 2100 degrees Fahrenheit (1149 degrees Celsius and higher)).

As shown in FIG. 5, the cold-end rotor 22 has an upper flange area 22U extending circumferentially around an upper portion of the cold-end rotor 22. The cold-end rotor 22 has a lower flange area 22L extending circumferentially around a lower portion of the cold-end rotor 22. The upper flange area 22U and the lower flange area 22L are separated by a recess 22R. A plurality of vanes 22V extend radially outward and are connected to the upper flange area 22U and the lower flange area 22L.

In one embodiment, the cold-end rotor 22 is manufactured from a plain carbon steel and is adapted to operate at an average temperature of about 450 degrees Fahrenheit (232 degrees Celsius).

As shown in FIG. 1, the rotor 20 includes the hot-end rotor assembly 24 disposed on the cold-end rotor 22 and positioned proximate the hot-end connecting plate 14. The hot-end rotor assembly 24 has a plurality of second flow passages 24P extending therethrough. The hot-end rotor 24 is configured in a hub, spoke and wheel configuration complementary to and mating with the socket configuration of the first channels associated with the dividing walls 22W, the second channel 22K and the third channel 22C.

Figure 2:
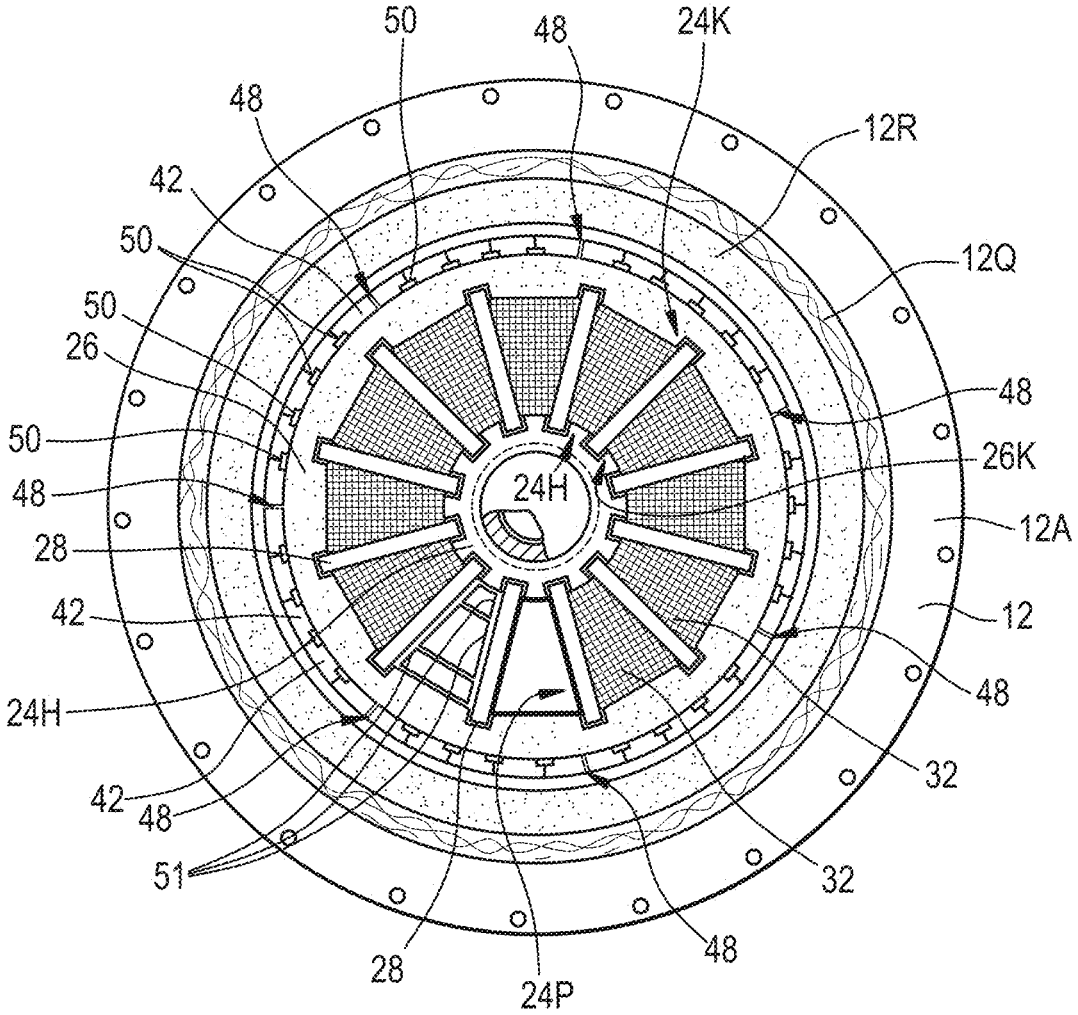
FIG. 2 a top cross sectional view of the rotary pre-heater of FIG. 1 taken across line 2-2.
Figure 3:
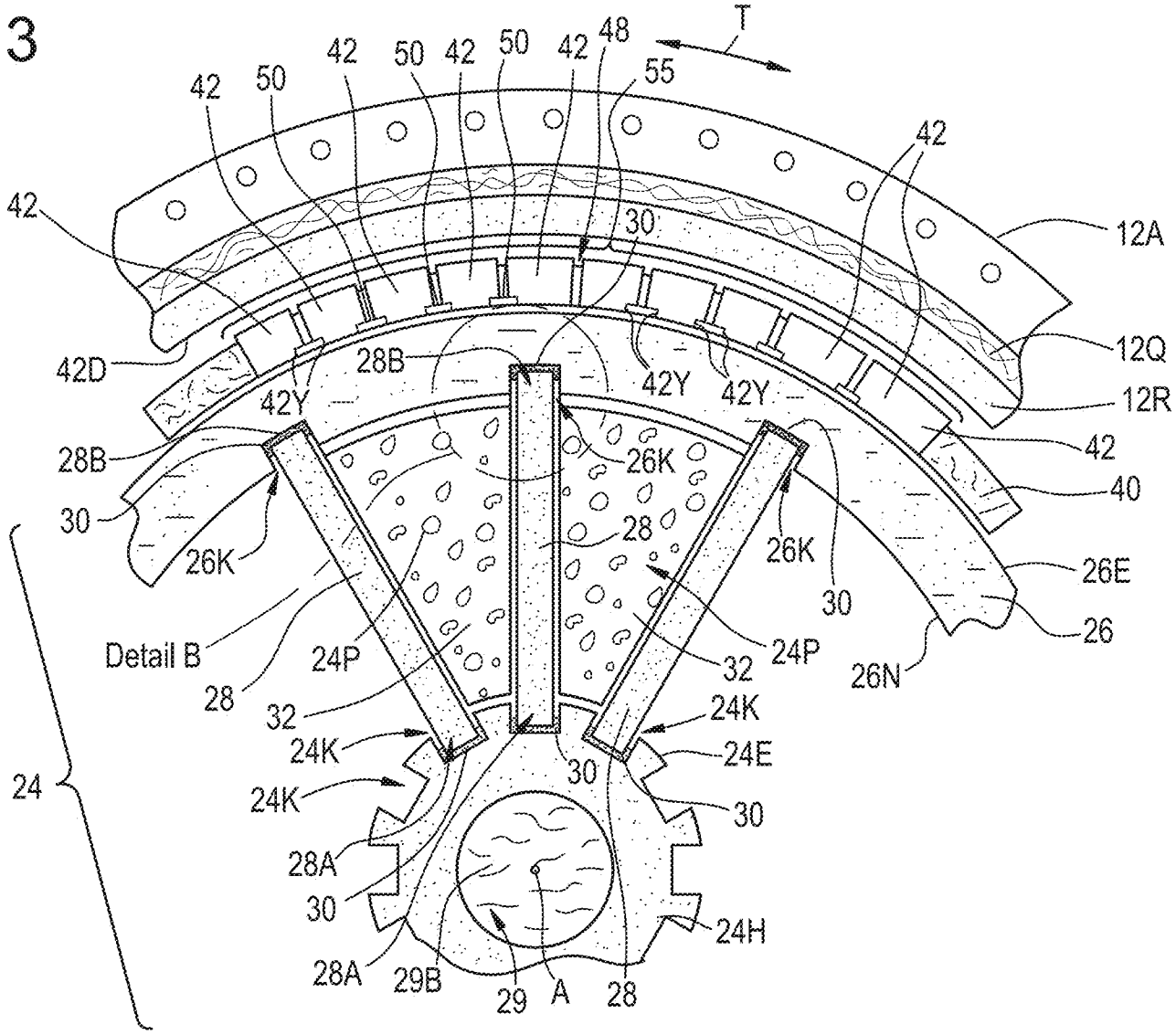
FIG. 3 is an enlarged view if a portion of the rotary pre-heater of FIG. 2.

As illustrated in FIGS. 2 and 3, the hot-end rotor assembly 24 includes a hub 24H that has an exterior surface 24E. The hot-end rotor assembly 24 has an annular rotor rim 26 positioned around and coaxially with the hub 24H. The rotor rim 26 has an interior surface 26N.

Figure 14:
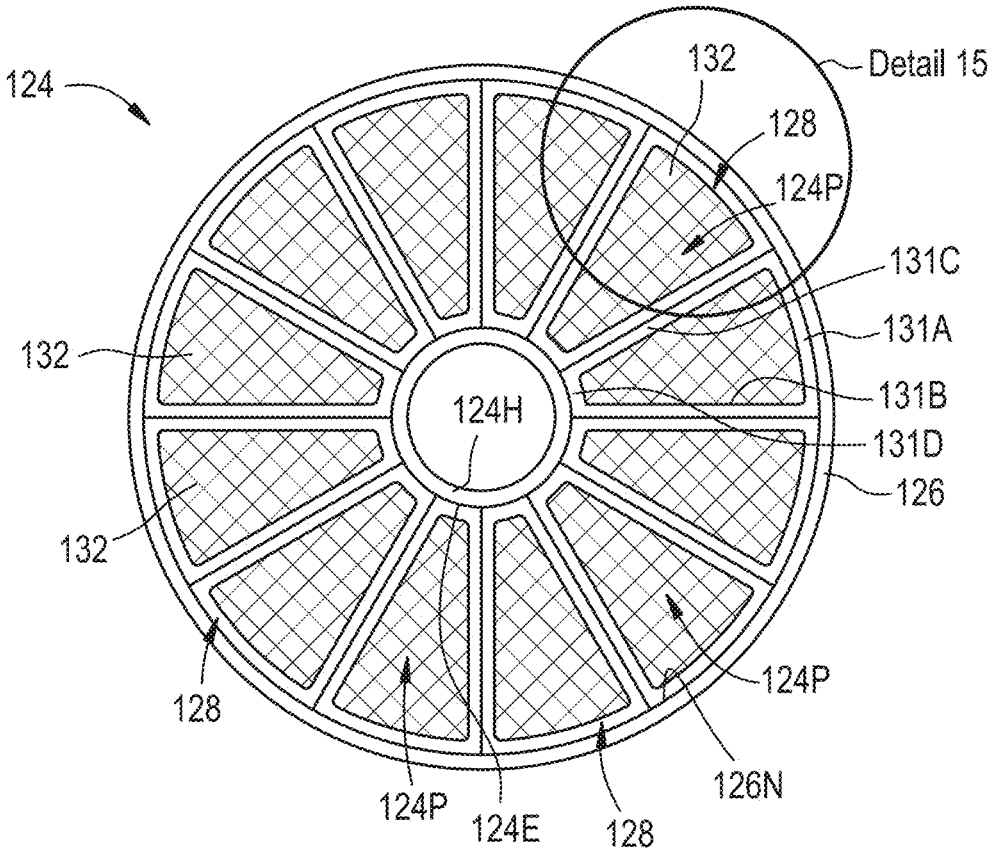
FIG. 14 is a top cross sectional view of another embodiment of the hot-end rotor of the rotary pre-heater of FIG. 1 taken across line 2-2.

The hot-end rotor assembly 124 of FIG. 14 is similar to the hot-end rotor assembly 24 of FIGS. 1-3, thus similar elements are assigned similar reference numbers preceded by the numeral 1. As illustrated in FIG. 14 the hot-end rotor assembly 124 includes a hub 124H that has an exterior surface 124E. The hot-end rotor assembly 124 has an annular rotor rim 126 positioned around and coaxially with the hub 124H. The rotor rim 126 has an interior surface 126N.

Figure 17:
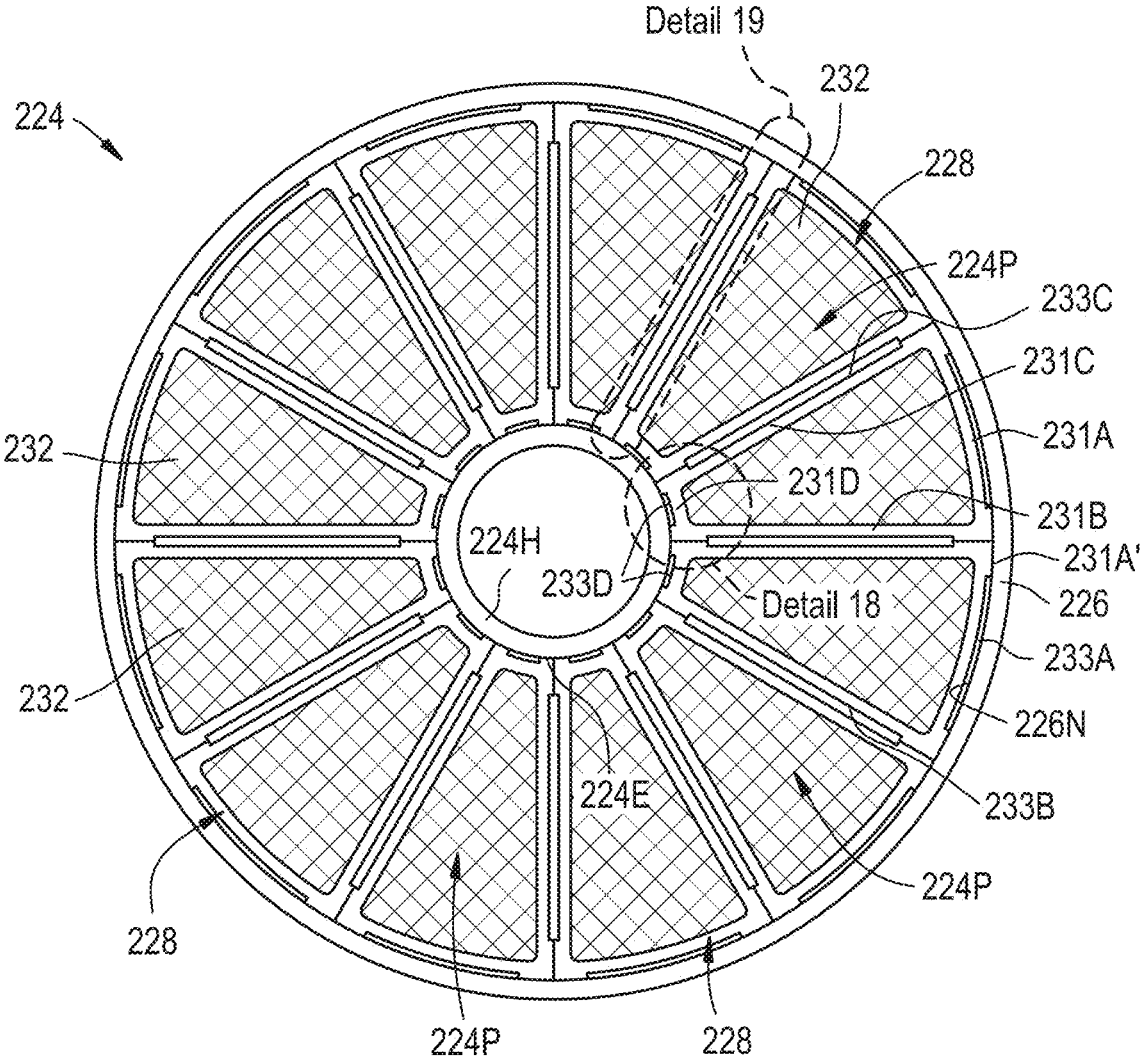
FIG. 17 is a top cross sectional view of another embodiment of the hot-end rotor of the rotary pre-heater of FIG. 1 taken across line 2-2.

The hot-end rotor assembly 224 of FIG. 17 is similar to the hot-end rotor assembly 24 of FIGS. 1-3, thus similar elements are assigned similar reference numbers preceded by the numeral 2. As illustrated in FIG. 17 the hot-end rotor assembly 224 includes a hub 224H that has an exterior surface 224E. The hot-end rotor assembly 224 has an annular rotor rim 226 positioned around and coaxially with the hub 224H. The rotor rim 226 has an interior surface 226N.

As illustrated in FIGS. 2 and 3, the exterior surface 24E has a plurality of first pockets in the form of first axial slots 24K (e.g., rectangular shaped elongate axial oriented recesses) formed therein. The hub 24H has a bore 29 extending therethrough. In one embodiment, the bore 29 has a ceramic fiber blanket 29B disposed therein. The interior surface 26N has a corresponding plurality of second pockets in the form of second axial slots 26K (e.g., rectangular shaped elongate axial oriented recesses) formed therein. The rotor rim 26 also defines a generally cylindrical exterior surface 26E.

As illustrated in FIGS. 2 and 3, the hot-end rotor assembly 24 includes a plurality of partitions 28 (e.g., spokes), extending (e.g., radially extend) between the hub 24H and the rotor rim 26. Each of the partitions 28 are located in a predetermined circumferential position and retained in the predetermined position by one or more alignment features. It will be appreciated that where alignment features are provided by frictional engagement, the predetermined circumferential position of partitions 28 is determined upon assembly, whereas when provided by locking engagement it is predetermined by the configuration of the flat exterior surfaces 224E. In the embodiment illustrated in FIGS. 2 and 3, the partitions 28 (e.g., spokes) each have a first terminal end 28A and a second terminal end 28B. The first terminal end 28A is seated in one of the first axial slots 24K and the second terminal end 28B is seated in the corresponding one of the second axial slots 26K, thereby collectively forming the alignment features. Each of the partitions 28 is configured to accommodate thermal expansion thereof Adjacent pairs of the partitions 28 (e.g., spokes), the exterior surface 24E of the hub 24H and the interior surface 26N of the rotor rim 26 collectively form the second flow passages 24P in the hot-end rotor assembly 24.

Figure 15:
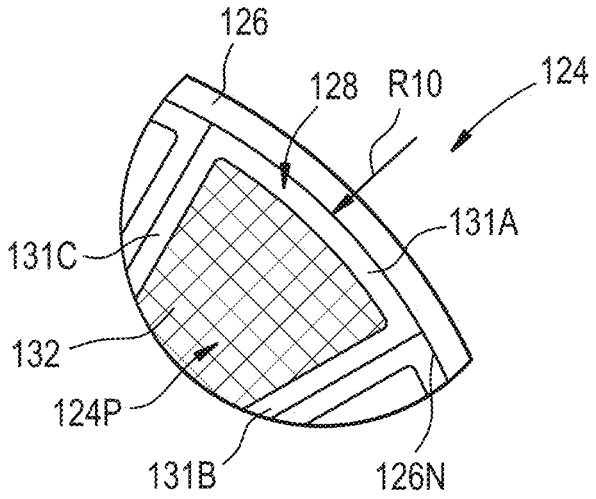
FIG. 15 is an enlarged view of detail 15 of FIG. 14.
Figure 16:
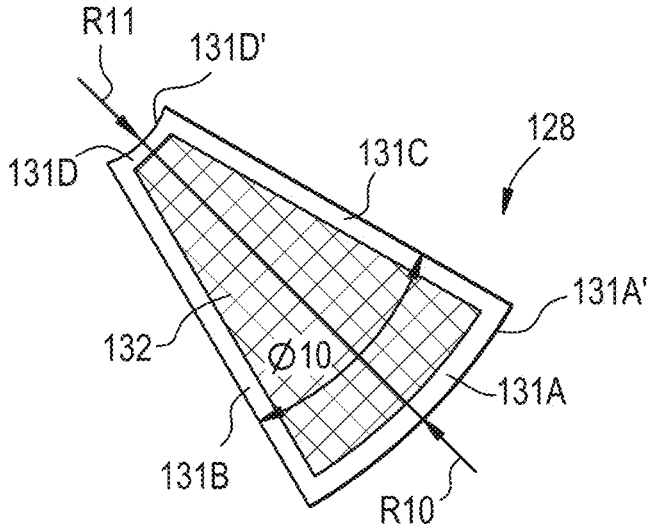
FIG. 16 is an enlarged view of one modular partition of FIG. 14.

While the adjacent pairs of the partitions 28 (e.g., spokes), the exterior surface 24E of the hub 24H and the interior surface 26N of the rotor rim 26 collectively form the second flow passages 24P in the hot-end rotor assembly 24 of FIGS. 1-3, the present invention is not limited in this regard as other configurations may form the flow passages. For example, as shown in FIG. 14, the flow passages 124P are formed by a modular unitary construction of the partitions 128. As best shown in FIG. 16, each of the partitions 128 is formed by a first radial section 131B and a second radial section 131C. The first radial section 131B and the second radial section 131C are integrally joined at radially outermost portions thereof by a first arcuate segment 131A. The first radial section 131B and the second radial section 131C are integrally joined at radially innermost portions thereof by a second arcuate segment 131D. The first radial section 131B and the second radial section 131C are oriented at an angle Ø10 relative to each other. The first arcuate segment 131A has an arcuate (e.g., a radius of curvature R10, as shown in FIGS. 15 and 16) exterior surface 131A' that is complementary in shape to the interior surface 126N of the rotor rim 126. The second arcuate segment 131D has an arcuate (e.g., a radius of curvature R11, as shown in FIG. 16) exterior surface 131D' that is complementary in shape to the exterior surface 124E of the hub 124H.

Similarly, as shown in FIG. 17, the flow passages 224P are formed by an arc shaped modular unitary construction of the partitions 228. Each of the partitions 228 is formed by a first radial section 231B and a second radial section 231C. The first radial section 231B and the second radial section 231C are integrally joined at radially outermost portions thereof by a first arcuate segment 231A. The first radial section 231B and the second radial section 231C are integrally joined at radially innermost portions thereof by a second segment 231D. The first radial section 231B and the second radial section 231C are oriented at an angle Ø10 relative to each other. The hub 224H has an exterior surface 224E that has a polygon shaped cross section having a plurality of flat surfaces 224E'. The first arcuate segment 231A has an arcuate exterior surface 231A' that is complementary in shape to the interior surface 226N of the rotor rim 226. The second segment 231D has a flat exterior surface 231D' that is complementary in shape to the flat exterior surface 224E of the hub 224H.

Figure 18:
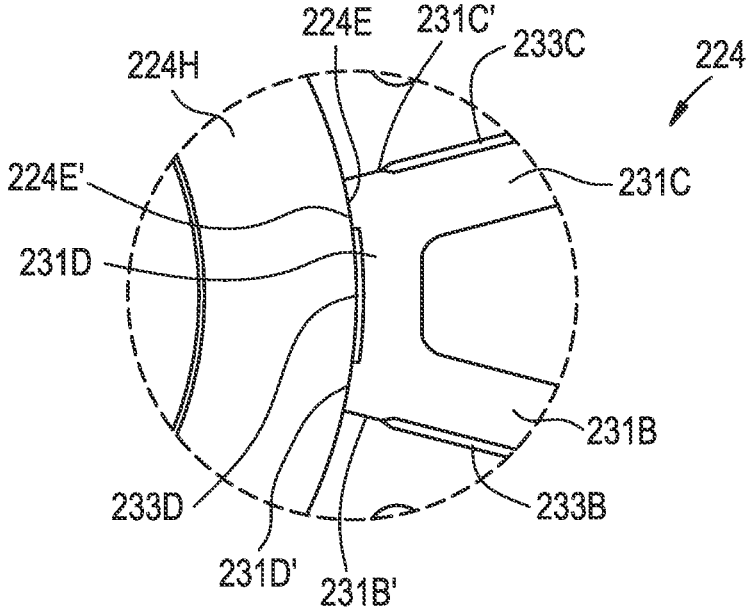
FIG. 18 is an enlarged view of detail 18 of FIG. 17.

While the hot-end rotor 24 of FIGS. 1-3 are shown and described as the alignment features being formed by the first terminal end 28A being seated in one of the first axial slots 24K and the second terminal end 28B being seated in the corresponding one of the second axial slots 26K, the present invention is not limited in this regard as the other alignment feature configurations may be employed. For example, as shown in FIGS. 14-16, the alignment feature of the hot-end rotor 124 includes: 1) the frictional engagement of the exterior surface 131A' with the interior surface 126N; and 2) the frictional engagement of exterior surface 131D' with the exterior surface 124E. As shown in FIGS. 17 and 18, the alignment feature of the hot-end rotor 224 includes: 1) the frictional engagement of the exterior surface 231A' with the interior surface 226N; and 2) the locking engagement of flat exterior surface 231D' with the flat exterior surface 224E.

Figure 20:
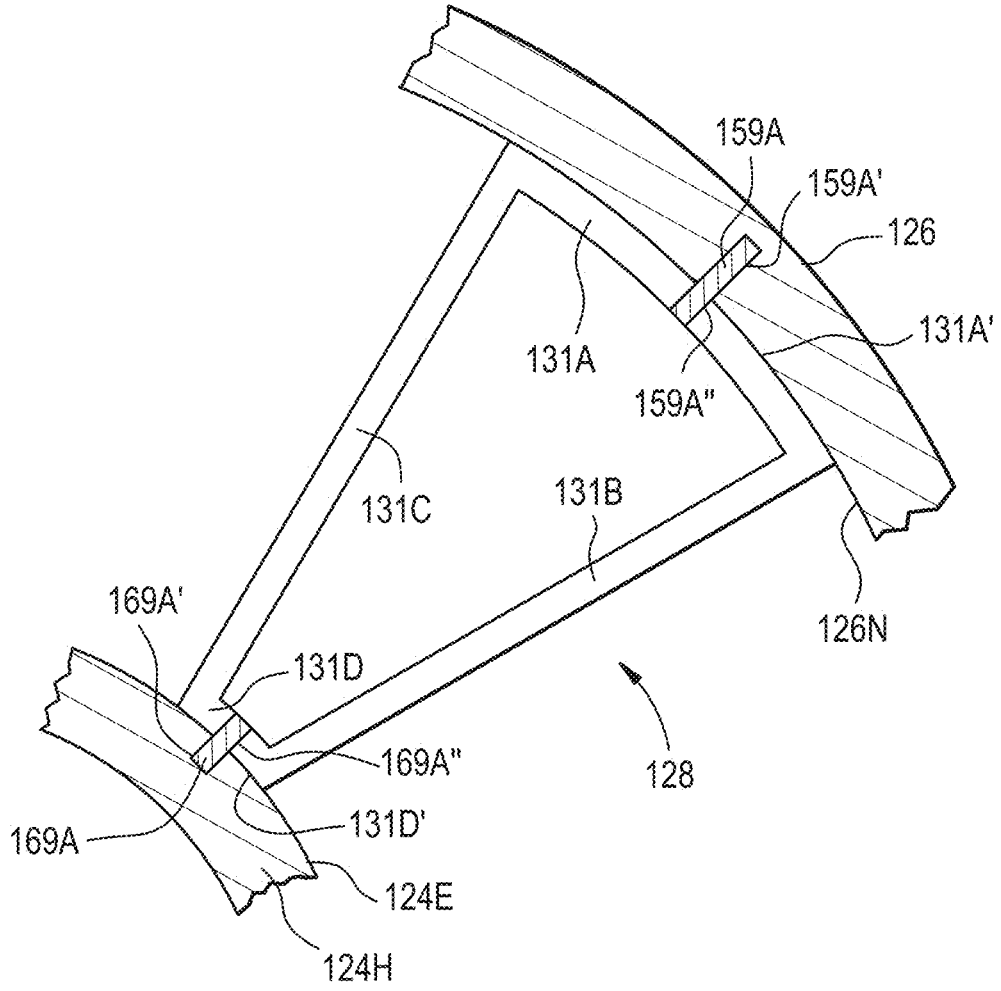
FIG. 20 is an enlarged view of a portion of the hot-end rotor of the rotary pre-heater of FIG. 1 showing a pinned connection between the partition, hub and the rotor rim.

As shown in the embodiment of FIG. 20, the alignment features include the one or more pins 159A fit into respective holes 159A' extending through the interior surface 126N and partially into the rotor rim 126 and respective holes 159A" extending through the exterior surface 131A' and entirely through the first arcuate segment 131A; and/or one or more pins 169A fit into respective holes 169A' extending through the exterior surface 124E and partially into the hub 124H and respective holes 169A" extending through the interior surface 131D' and entirely through the second arcuate segment 131D. While the holes 159A' are described as extending partially into rotor rim 126, the present invention is not limited in this regard as the holes 159A' and pins 159A may extend entirely through rotor rim 126. While the holes 159A" are described as extending through the exterior surface 131A' and entirely through the first arcuate segment 131A, the present invention is not limited in this regard as the holes 159A" and pins 159A may extend partially through the first arcuate segment 131A. While the holes 169A' are described as extending through the exterior surface 124E and partially into the hub 124H, the present invention is not limited in this regard as the holes 169A' and pins 169A may extend entirely through the hub 124H. While the holes 169A" are described as extending through the interior surface 131D' and entirely through the second arcuate segment 131D, the present invention is not limited in this regard as the holes 169A" and pins 169A my extend partially into the second arcuate segment 131D.

Figure 21:
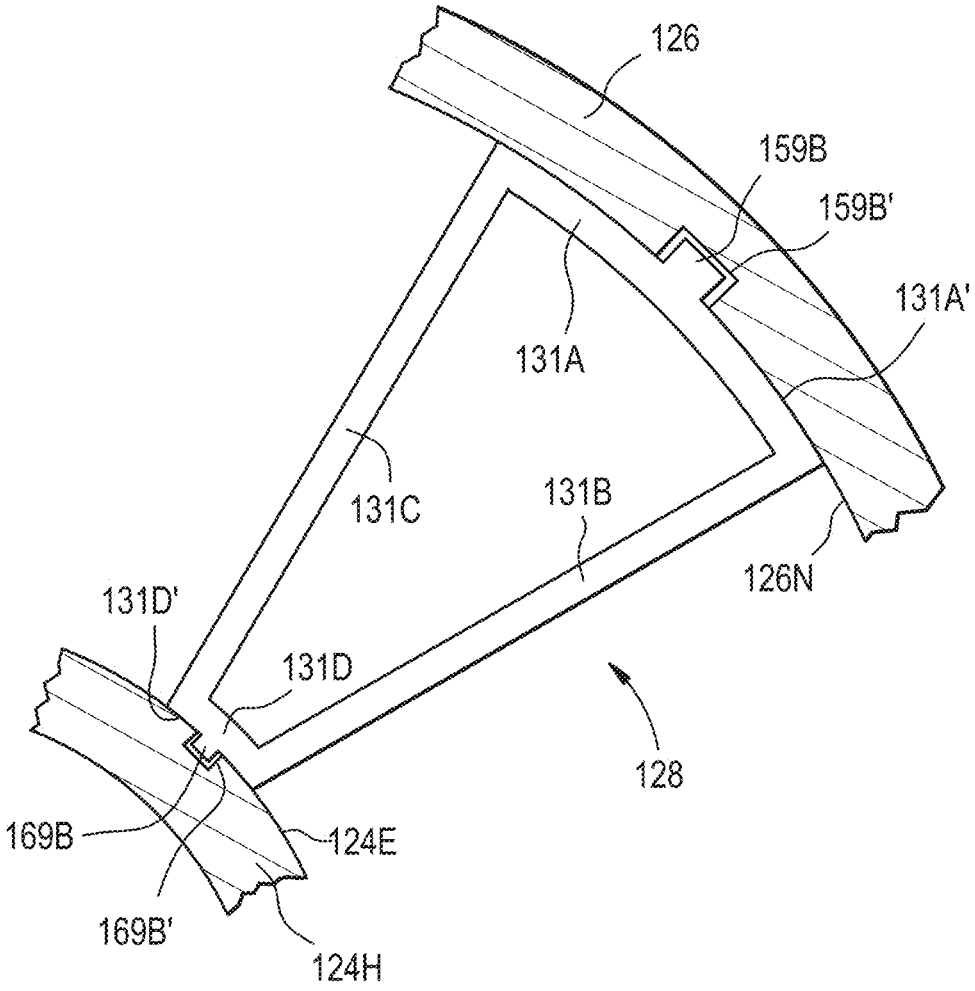
FIG. 21 is an enlarged view of a portion of the hot-end rotor of the rotary pre-heater of FIG. 1 showing keys extending from the partition for engaging slots in the hub and the rotor rim.

As shown in the embodiment of FIG. 21, the alignment features include one or more keys 159B (e.g., rectangular ridges) extending outwardly from exterior surface 131A' that are fit into one or more respective slots 159B' in the interior surface 126N; and/or one or more keys 169B (e.g., rectangular ridges) extending from the exterior surface 131D' and fit into respective slots 169B' in the exterior surface 124E.

Figure 22:
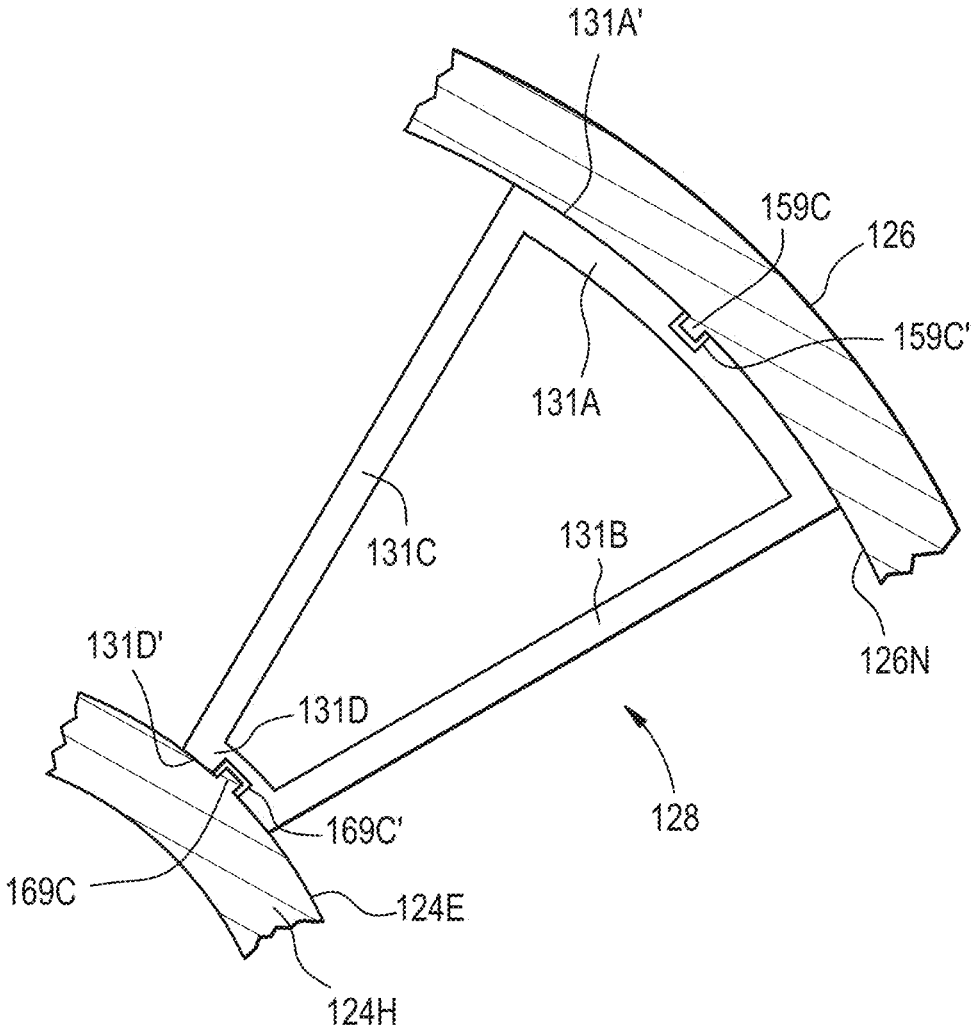
FIG. 22 is an enlarged view of a portion of the hot-end rotor of the rotary pre-heater of FIG. 1 showing slots in the partition for receiving keys extending from the hub and the rotor rim.

As shown in the embodiment of FIG. 22, the alignment features include one or more keys 159C (e.g., rectangular ridges) extending outwardly from the interior surface 126N that are fit into one or more respective slots 159C' in the exterior surface 131A'; and/or one or more keys 169C (e.g., rectangular ridges) extending outwardly from the hub 124H and fit into respective slots 169C' in the exterior surface 131D'.

Figure 19:
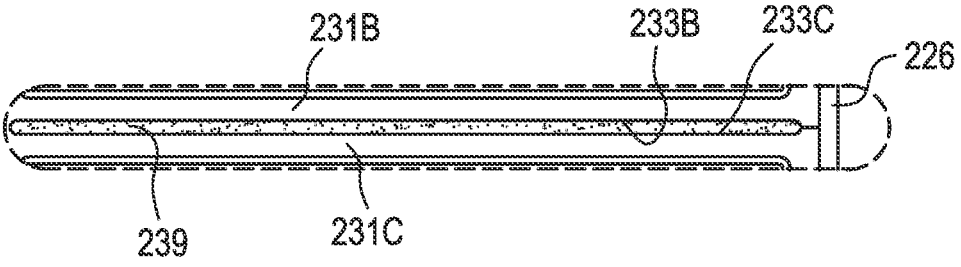
FIG. 19 is an enlarged view of detail 19 of FIG. 17.

Referring back to FIGS. 17-19, each of the partitions 228 have recesses formed on exterior surfaces thereof. For example, the arcuate exterior surface 231A' of the 231A first arcuate segment 231A has a recess 233A formed therein; the exterior surface 231D' of the second arcuate segment 231D has a recess 233D formed therein; the exterior surface 231B' of the first radial section 231B has a recess 233B formed therein; and the exterior surface 231C' of the second radial section 231C has a recess 233C formed therein. In one embodiment, there is a filler material 239, such as a mortar (e.g., cement) disposed in the recesses 233A, 233B, 233C and/or 233D. In some embodiments, the filler material 239, the spokes 28, the rotor rim 26, and/or the hub 24H are manufactured from a ceramic material, such as a ceramic casting. In one embodiment, the spokes 28, the rotor rim 26, and/or the hub 24H are manufactured from a sintered ceramic material.

Figure 11:
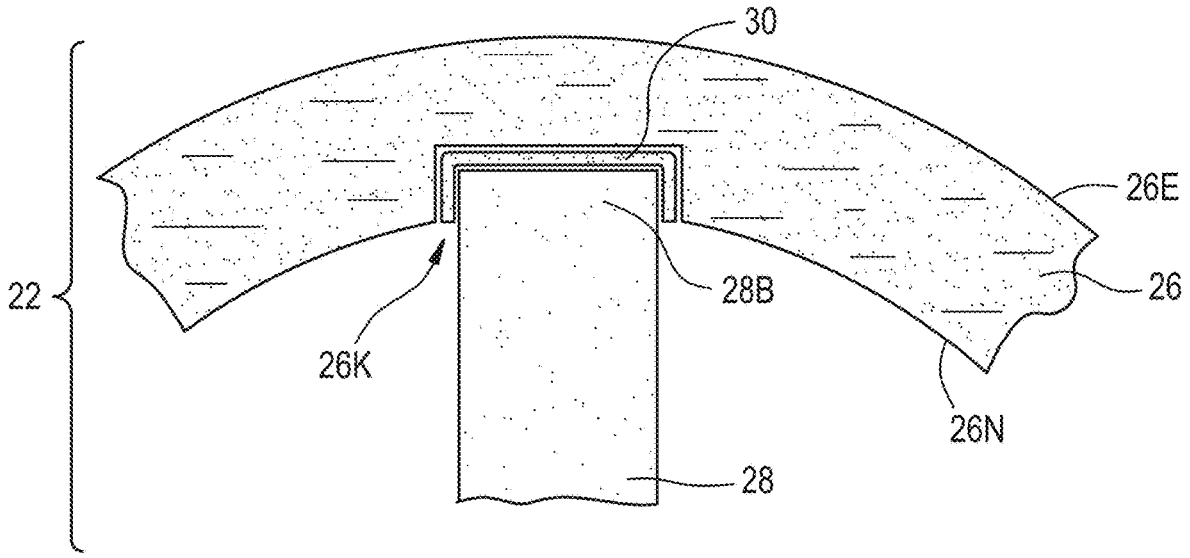
FIG. 11 is an enlarged view of a portion of the ceramic rotor portion of detail B of FIG. 3.

As illustrated in FIGS. 2, 3 and 11, a ceramic fiber blanket 30 is disposed as packing material at the second terminal end 28B of the spoke 28, in one of the second slots 26K. As shown in FIG. 3, another ceramic fiber blanket 30 is disposed at the first terminal end 28A of the spoke 28, in one of the first slots 24K. The ceramic fiber blankets 30 are adhered to the respective one of the first terminal end 28A and the second terminal end 28B with a sacrificial adhesive to facilitate assembly. This facilitates the spokes 28 being keyed into their respective slots 24K during assembly of the hot-end rotor assembly 24. During operation, the sacrificial adhesive burns off. It will be appreciated that, while ceramic fiber blanket is the preferred packing material, any other suitable heat resistant material can be used, for example fibrous matting, felt or woven material.

Figure 12:
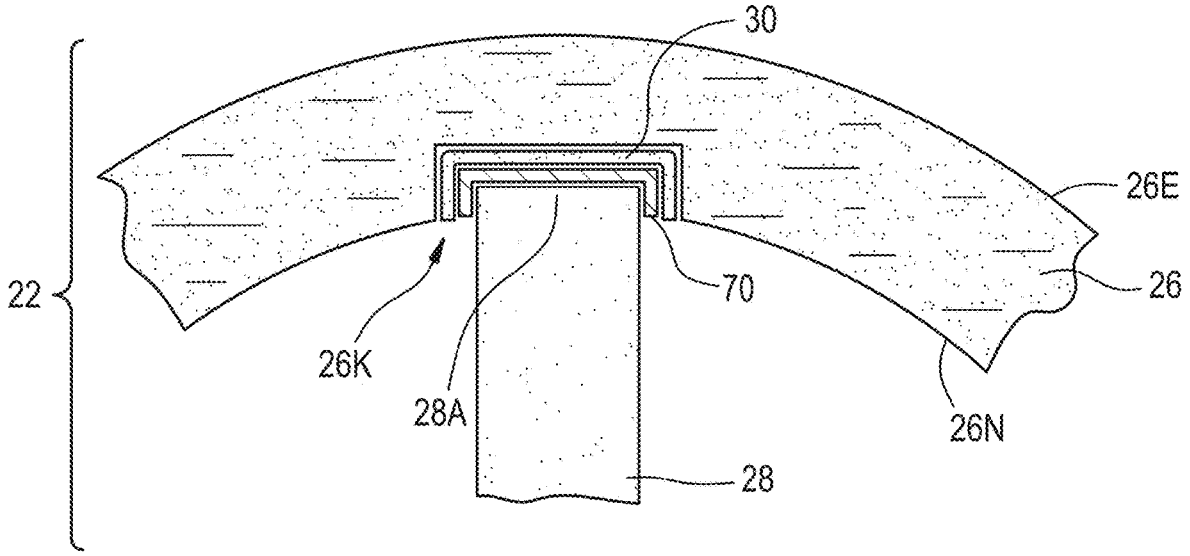
FIG. 12 is an enlarged view of a portion of another embodiment of the ceramic rotor portion of detail B of FIG. 3.
Figure 13:
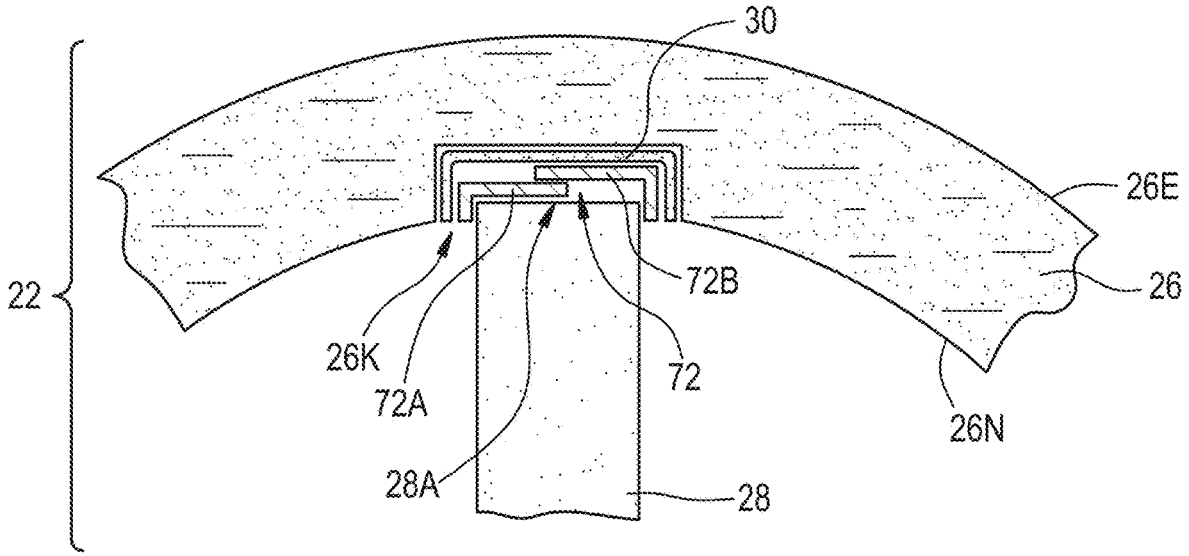
FIG. 13 is an enlarged view of a portion of yet another embodiment of the ceramic rotor portion of detail B of FIG. 3.

While the ceramic fiber blanket 30 is shown and described as being between the second terminal end 28B of the spoke 28 in one of the second slots 26K and/or another ceramic fiber blanket 30 is disposed between the first terminal end 28A of the spoke 28 in one of the first slots 24K, the present invention is not limited in this regard as other configurations may be employed including but not limited to the embodiments illustrated in FIGS. 12 and 13. For example, as illustrated in FIG. 12, a channel member 70 (e.g., a metallic or stainless steel channel having a C-shaped cross section) is disposed on a respective one or more of the first terminal end 28A and the second terminal end 28B; and the first ceramic fiber blanket 30 is disposed on (e.g., adhered to) the channel member 70. In one embodiment, the relative position of the channel member 70 and the ceramic fiber blanket may be reversed so that the ceramic fiber blanket 30 is disposed on a respective one or more of the first terminal end 28A and the second terminal end 28B and the channel 70 is disposed over the ceramic fiber blanket 30. The channel member 70 increases the strength of the hot-end rotor assembly 24 at elevated temperatures (e.g., 2100 degrees Fahrenheit (1149 degrees Celsius)).

In one embodiment, as illustrated in FIG. 13, a channel member 72 is defined by two segments 72A and 72B, each having an L-shaped cross section and a portion of each of the two segments 72A and 72B overlap each other. A ceramic fiber blanket 30 is positioned over the channel member 72.

This embodiment permits the overlapping portions to slide one against the other to accommodate thermal expansion and contraction without applying any substantial circumferential loading to side walls of the respective slots 26K (or 24K) within which they are seated.

Figure 6:
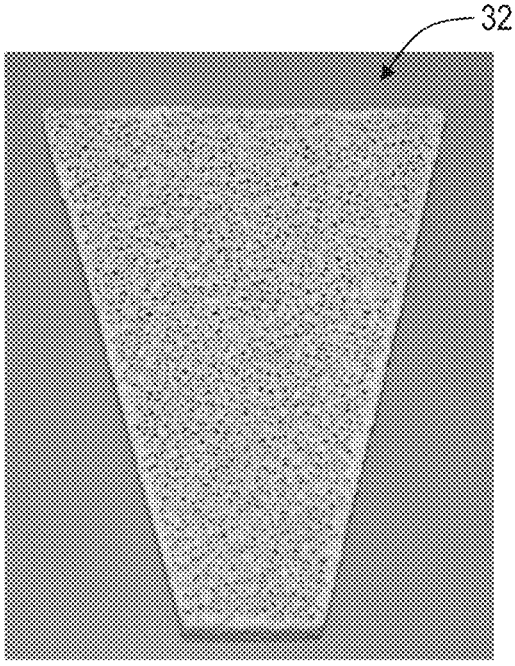
FIG. 6 is a schematic drawing of a ceramic heat transfer media section for installation in the hot-side rotor of FIG. 3.
Figure 7:
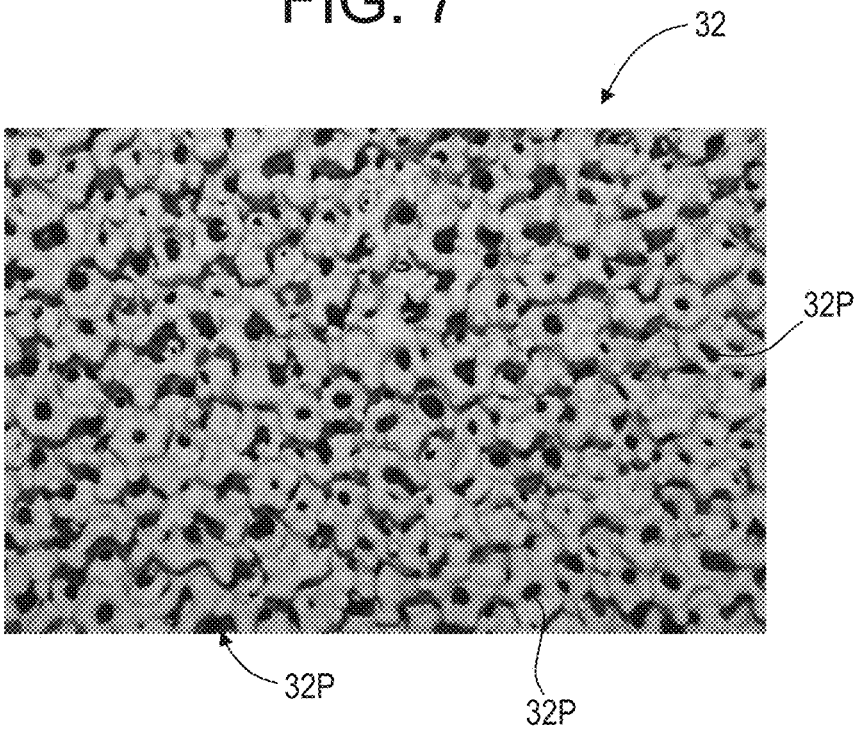
FIG. 7 is an enlarged view of a portion of the ceramic heat transfer media section of FIG. 6.

As shown in FIGS. 1 and 2, each of the flow passages 24P in the hot-end rotor assembly 24 has a stack of heat transfer plates 32 disposed therein and supported by a rack configuration 51. The heat transfer plates 32 are generally trapezoidal shaped (see FIG. 6) complementarily to the trapezoidal shape of the first flow passages 22P. The heat transfer plates 32 are made from a porous ceramic sponge-like material, such as cordierite, that has a plurality of open pores 32P extending therethrough as shown in FIG. 7.

Figure 8:
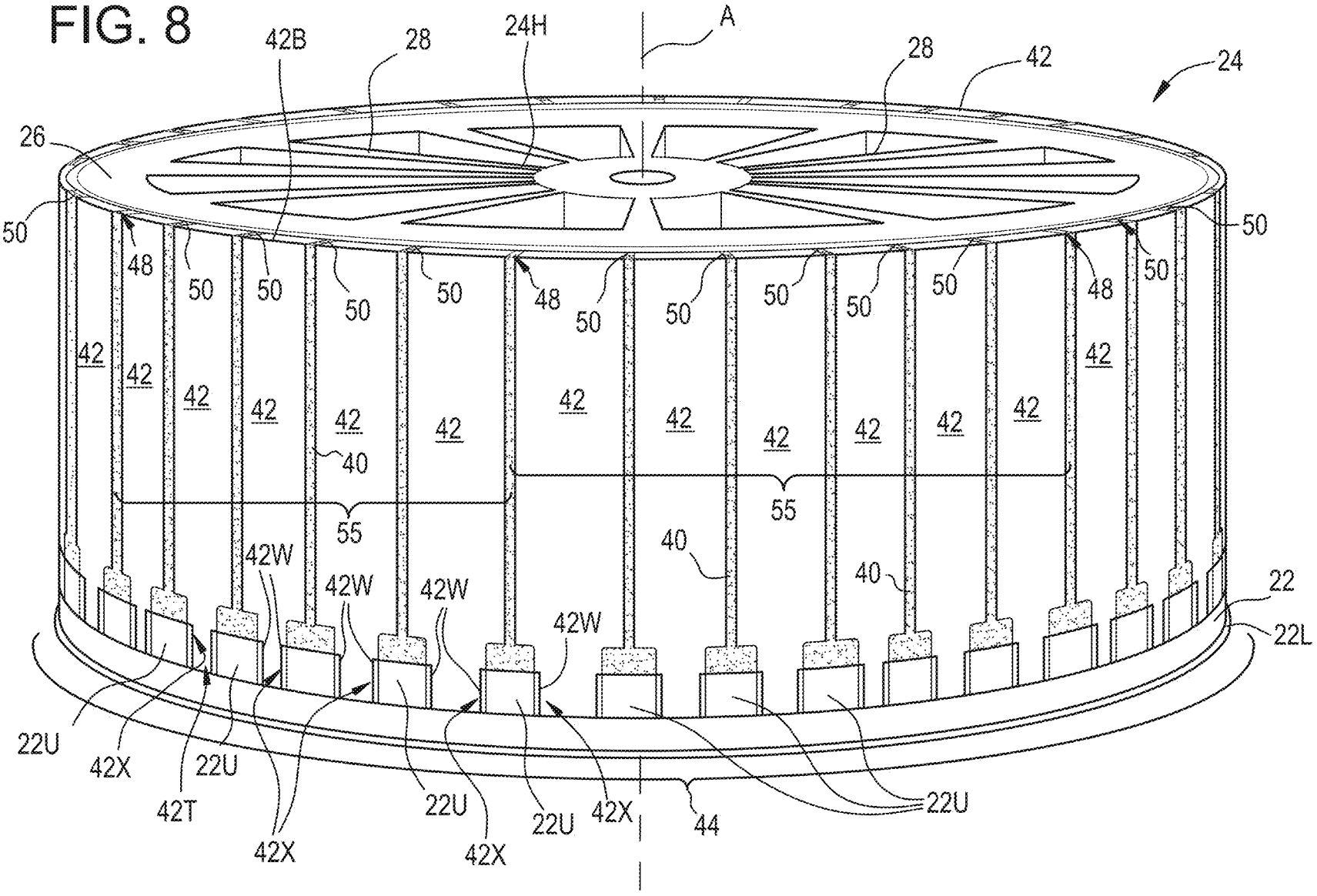
FIG. 8 is a perspective view of a ceramic rotor portion of the rotary pre-heater of FIG. 1.
Figure 9:
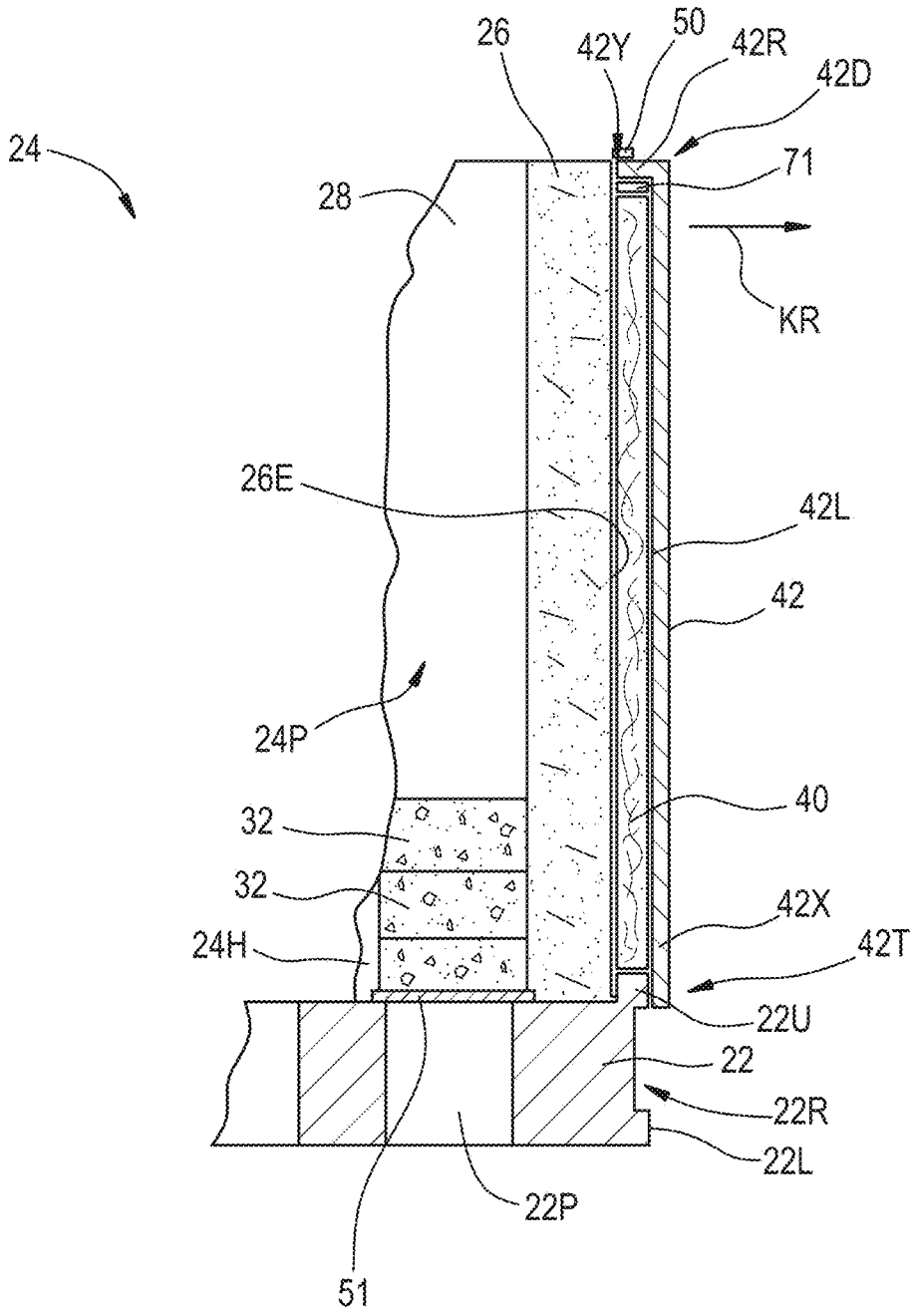
FIG. 9 is an enlarged view of detail A of FIG. 1.
Figure 10:
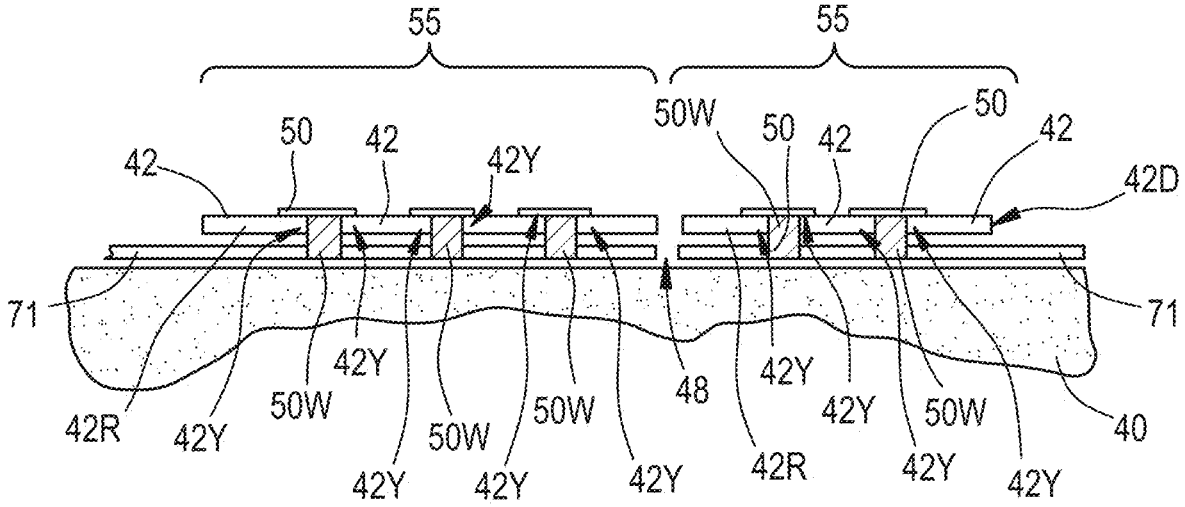
FIG. 10 is a detailed cross sectional view of a portion of two groups of retainer elements.

As illustrated in FIGS. 1, 2 and 9, the rotor rim 26 has an insulation assembly surrounding the exterior surface 26E. The insulation assembly includes a ceramic fiber blanket 40 surrounding and in contact with the exterior surface 26E. As shown in FIGS. 2, 8 and 9, the insulation assembly includes an insulation retaining assembly 44 encapsulating the ceramic fiber blanket 40. The insulation retaining assembly 44 includes a plurality of elongate retainer elements 42. As shown in FIG. 9, each of the retainer elements 42 has a first connection area 42X at one root end 42T thereof (e.g., bottom end, or end adjacent to the cold-end rotor 22); and a second connection area 42Y at the other end (i.e., distal end 42D) thereof (e.g., an upper end or an end adjacent to the hot-end connection plate 14). In one embodiment, the retainer element 42 has an inverted L-shaped configuration defining an elongate first leg 42L (e.g., long leg) and a short second leg 42R (e.g., short leg), with the second leg 42R extending radially inward from the first leg 42L. As shown in FIG. 9, the second connection areas 42Y are positioned on a radially inward end of the second leg 42R. Each of the retainer elements 42 has two first connection areas 42X (as best shown in FIG. 8) and two second connection areas 42Y, as best shown in FIG. 10. As shown in FIG. 10, the second connection areas 42Y of adjacent retainer elements 42 of each group 55 of the retainer elements 42 are connected to one another by a weld 50W. A backing plate (e.g., an arcuate segment 71 of a circumferential length about equal to a length of the group 55 of retainer elements 42) is positioned under the short second leg 42R of the retainer elements 42. A connector plate 50 extends between adjacent ones of the short second leg 42R of the retainer elements 42. The connector plate 50, the short second leg 42R and portions of the backing plate 71 are connected to one another, for example, by the weld 50W. Thus, adjacent ones of second connection areas 42Y of adjacent retainer elements 42 of each group 55 of the retainer elements 42 are restrained from circumferential movement relative to one another.

While the connector plate 50, the short second leg 42R and portions of the backing plate 71 are shown and described as being connected to one another by the welds 50W the present invention is not limited in this regard as the adjacent retainer members 42, the connector plates 50, the short second legs 42R and/or portions of the backing plates 71 may be secured to one another at the second connection areas 42X or other suitable areas by suitable fasteners.

As shown in FIGS. 2 and 8, the insulation retaining assembly 44 includes a plurality of groups 55 of retainer elements 42. Each of the plurality of groups 55 have at least two of the retainer elements 42 connected to one another as described herein. For example, the groups 55 shown in FIG. 2, each have five of the adjacent retainer elements 42 secured to one another at the first connection area 42X and the second connection area 42Y. Collectively, these form a structurally stable arcuate section of bound together retainer elements 42 that can withstand the mechanical effects of thermal expansion and rotation typical during operation of the preheater. While the groups in FIG. 2 are shown and described as having five retainer elements 42, the present invention is not limited in this regard as at least two retainer elements 42 may be employed in each group 55. Alternatively, retainer elements 42 could be constructed from broad sheet material provided with an arcuate cross-sectional profile providing the requisite structural stability at the distal ends 42D thereof.

As shown in FIG. 8, the retainer elements 42 of each of the groups 55 are connected to the upper flange area 22U at the first connection areas 42X, for example by welds 42W joining the first connection areas 42X to the upper flange area 22U, thereby forming a closed loop about a central axis A such that there is no or essentially no circumferential movement of adjacent ones of the first connection areas 42X relative to one another or to the upper flange area 22U. While the retainer elements 42 are described as being connected to the upper flange area 22U at the first connection areas 42X by welds 42W, the present invention is not limited in this regard as the retainer elements 42 may be connected to the upper flange area 22U by other suitable means, such as but not limited to threaded fasteners extending therethrough and threaded into respective threaded bores in the upper flange area 22U.

Adjacent ones of the groups 55 of retainer elements 42 are separate from one another outside of the second connection area 42Y (e.g., are not connected to one another at the second connection areas 42Y) thereby forming a gap 48 between adjacent groups 55 at the second connection areas 42Y. Portions of each (i.e., portions extending away from the first connection areas 42X and away from the root ends 42T, such as the groups 55 of the second connection areas 42Y secured together and the distal ends 42D) of the groups 55 of retainer elements 42 are moveable in a circumferential direction as indicted by the arrows T in FIG. 3, in response to thermal expansion of the rotor rim 26 and/or the ceramic fiber blanket 40, while the arcuate shape of the groups 55 retains the ceramic fiber blanket 40 in a predetermined position (e.g., against the exterior surface 26E). However, each of the second connection areas 42Y, distal ends 42D and the portions extending away from the first connection areas 42X have essentially no radial movement in the direction of the arrow KR in FIG. 9, as a result of thermal expansion and heating of the rotor rim 26 and/or the ceramic fiber blanket 40. The movability of the retainer elements 42 in the circumferential direction prevents the retainer elements 42 from deflecting radially outward and prevents interference of the hot-end rotor assembly 24 with the refractory 12R during rotation of the hot-end rotor assembly 24 at elevated temperatures (e.g., 2100 degrees Fahrenheit (1149 degrees Celsius)).

In one embodiment, the retainer elements 42 are manufactured from a high alloy steel such as but not limited to a type 4562 nitrogen iron nickel chrome molybdenum alloy steel. In one embodiment, the retainer elements 42 are manufactured from the type 4562 nitrogen iron nickel chrome molybdenum alloy steel are welded to the plain carbon steel cold-end rotor 22 via a bi-metallic weld procedure. There is disclosed herein a method for assembling the hot-end rotor 24 to the cold-end rotor 22. The method includes providing the cold-end rotor 22 comprising a plain carbon steel, providing the hot-end rotor 24 comprising a ceramic material, such as a ceramic casting, and providing a plurality of retainer elements 42 comprising a high alloy steel (e.g., type 4562 nitrogen iron nickel chrome molybdenum alloy steel). The method includes wrapping a circumferential exterior surface of the hot-end rotor 24 with the ceramic fiber blanket 40 and positioning a plurality of groups 55 of a plurality of the retainer elements 42 circumferentially around the hot-end rotor 24. The method includes connecting each of the plurality of retainer elements 42 to a circumferential exterior surface of the cold-end rotor 22 (e.g., the upper flange area 22U) via one or more bimetallic welds between and joining the retainer elements 42 to the circumferential exterior surface of the cold-end rotor 22. Although the present invention has been disclosed and described with reference to certain embodiments thereof, it should be noted that other variations and modifications may be made, and it is intended that the following claims cover the variations and modifications within the true scope of the invention.

What is claimed is:

1. A rotor for a high temperature rotary pre-heater, the rotor comprising:

a hub having an exterior circumferential surface thereon;

a continuous circumferential annular rim positioned around and coaxially with the hub, the annular rim having an interior circumferential surface;

a plurality of partitions extending between the hub and the annular rim, each of the partitions comprising:

a first radial section, a second radial section, an arcuate inner segment extending continuously between and integral with innermost ends of the first radial section and the second radial section, and an arcuate outer segment extending continuously between and integral with outermost ends of the first radial section and the second radial section, wherein the first radial section, the second radial section, the arcuate inner segment and the arcuate outer segment form a closed loop arc shaped modular unitary construction, each of the partitions being located in a predetermined circumferential position by at least one alignment feature, each partition touching an immediately adjacent partition on either side thereof to accommodate thermal expansion of adjacent partitions relative to one another;

a radially inward facing circumferential surface of the arcuate inner segment directly engaging the exterior circumferential surface and a radially outward facing circumferential surface of the arcuate outer segment engaging the interior circumferential surface; and at least one of the exterior circumferential surface, the interior circumferential_surface and the partitions having at least one of the alignment features thereon.

2. The rotor of claim 1, wherein the at least one alignment feature on at least one of the exterior circumferential surface of the hub, the interior circumferential surface of the annular rim and the partition comprises an anti-rotation feature configured to maintain the predetermined circumferential position of the respective partition and to allow axial movement of the partition relative to the hub and annular rim.

3. The rotor of claim 1, further comprising at least one recess extending along at least one of the radially outward facing circumferential surfaces of the arcuate outer segment of the partition and comprising filler material disposed in the at least one recess.

4. The rotor of claim 1, wherein at least one of the hub, the annular rim and at least one of the plurality of partitions consists of a ceramic material.

5. A rotary pre-heater comprising:

an annular housing;

a hot-end connecting plate having a first inlet and a first outlet, the hot-end connecting plate being secured to a first axial end of the annular housing;

a cold-end connecting plate having a second inlet and a second outlet, the cold-end connecting plate being secured to a second axial end of the annular housing;

a rotor disposed for rotation in the annular housing and between the hot-end connecting plate and the cold-end connecting plate, the rotor comprising:

a cold-end rotor mounted for rotation on a spindle proximate the cold-end connecting plate, the cold-end rotor having a first plurality of flow passages extending therethrough;

a hot-end rotor assembly disposed on the cold-end rotor, the hot-end rotor assembly being proximate the hot-end connecting plate, the hot-end rotor assembly having a second plurality of flow passages extending therethrough, the hot end rotor comprising:

a hub having an exterior circumferential surface thereon;

a continuous circumferential annular rim positioned around and coaxially with the hub, the annular rim having an interior circumferential surface; and a plurality of partitions extending between the hub and the annular rim, each of the partitions comprising:

a first radial section, a second radial section, an arcuate inner segment extending continuously between and integral with innermost ends of the first radial section and the second radial section, an arcuate outer segment extending continuously between and integral with outermost ends of the first radial section and the second radial section, wherein the first radial section, the second radial section, the arcuate inner segment and the arcuate outer segment form a closed loop arc shaped modular unitary construction, each of the partitions being located in a predetermined circumferential position by at least one alignment feature, each partition touching an immediately adjacent partition on either side thereof to accommodate thermal expansion of adjacent partitions relative to one another; and a radially inward facing circumferential surface of the arcuate inner segment directly engaging the exterior circumferential surface and a radially outward facing circumferential surface of the arcuate outer segment engaging the interior circumferential surface; wherein at least one of the exterior circumferential surface, the interior circumferential surface and the partitions having at least one alignment feature thereon.

6. The rotary pre-heater of claim 5, wherein the at least one alignment feature on at least one of the exterior circumferential surface of the hub, the interior circumferential surface of the annular rim and the partition comprises an anti-rotation feature configured to maintain the predetermined circumferential position of the respective partition and to allow axial movement of the partition relative to the hub and annular rim.

7. The rotary pre-heater of claim 5, wherein at least one of the flow passages is arc shaped.

8. The rotary pre-heater of claim 5, further comprising at least one recess extending along at least one of the radially outward facing circumferential surfaces of the arcuate outer segment of the partitions and comprising a filler material disposed in the at least one recess.

9. The rotary pre-heater of claim 5, wherein at least one of the hub, the annular rim and at least one of the plurality of partitions consists of a ceramic material.

10. A rotary pre-heater comprising:

an annular housing;

a hot-end connecting plate having a first inlet and a first outlet, the hot-end connecting plate being secured to a first axial end of the annular housing;

a cold-end connecting plate having a second inlet and a second outlet, the cold-end connecting plate being secured to a second axial end of the annular housing;

a rotor disposed for rotation in the annular housing and between the hot-end connecting plate and the cold-end connecting plate, the rotor comprising:

a cold-end rotor mounted for rotation on a spindle proximate the cold-end connecting plate, the cold-end rotor having a first plurality of flow passages extending therethrough;

a hot-end rotor assembly disposed on the cold-end rotor, the hot-end rotor assembly being proximate the hot-end connecting plate, the hot-end rotor assembly having a second plurality of flow passages extending therethrough, the hot end rotor comprising:

a hub having an exterior circumferential surface thereon;

a continuous circumferential annular rim positioned around and coaxially with the hub, the annular rim having an interior circumferential surface; and a plurality of partitions extending radially between the hub and the annular rim, each of the partitions located in a predetermined circumferential position and retained in the predetermined circumferential position by at least one alignment feature; wherein the at least one alignment feature being:

(a) in communication with the exterior circumferential surface and one of the plurality of partitions; and (b) in communication with the interior circumferential surface and one of the partitions, so that each of the partitions accommodate thermal expansion, wherein:

each of the partitions are radially extending spokes having a first terminal end adjacent the external circumferential surface of the hub and extending to a second terminal end adjacent the interior circumferential surface of the annular rim;

at least one of the alignment features on the exterior circumferential surface of the hub comprises an axially extending first slot;

at least one of the alignment features on the interior circumferential surface of the annular rim comprises an axially extending second slot; and the first terminal end is seated in a respective one of the axially extending first slots and the second terminal end is seated in a corresponding respective one of the axially extending second slots.

11. The rotary pre-heater of claim 10, further comprising:

a ceramic fiber blanket disposed between at least one of:

the first terminal end and the respective one of the axially extending_first slots; and the second terminal end and the respective one of the axially extended_second slots.

12. The rotary pre-heater of claim 11, wherein the ceramic fiber blanket is adhered to the at least one of the first terminal end and the second terminal end with a sacrificial adhesive facilitating the spokes to be keyed into corresponding first and second slots during assembly.

13. A rotor for a high temperature rotary pre-heater, the rotor comprising:

a hub having an exterior circumferential surface thereon;

a continuous circumferential annular rim positioned around and coaxially with the hub, the annular rim having an interior circumferential surface;

a plurality of partitions extending radially between the hub and the annular rim, each of the partitions located in a predetermined circumferential position and retained in the predetermined circumferential position by at least one alignment feature; and at least one of the exterior circumferential surface, the interior circumferential surface and the partitions having at least one of the alignment features thereon, wherein at least one of the partitions comprises a plurality of radially extending spokes having a first terminal end adjacent the external circumferential surface of the hub and extending to a second terminal end adjacent the interior circumferential surface of the annular rim;

at least one of the alignment features on the exterior circumferential surface of the hub comprises an axially extending first slot;

at least one of the alignment features on the interior circumferential surface of the annular rim comprises an axially extending second slot;

the first terminal end is seated in a respective one of the axially extending first slots and the second terminal end is seated in a corresponding respective one of the axially extending second slots; and a first ceramic fiber blanket disposed between at least one of:

the first terminal end and the respective one of the axially extending first slots; and the second terminal end and the respective one of the axially extending_second slots.

14. The rotor of claim 13, wherein the ceramic fiber blanket is adhered to at least one of the first terminal end and the second terminal end with a sacrificial adhesive facilitating the spokes to be keyed into corresponding first and second slots during assembly.

15. The rotor of claim 13, further comprising a channel member disposed on at least one of the first terminal end and the second terminal end.

16. The rotor of claim 1, wherein the hub comprises a bore extending axially therethrough.

17. The rotor of claim 16, wherein the bore is filled with a ceramic fiber blanket.

18. A rotor for a high temperature rotary pre-heater, the rotor comprising:

a hub having an exterior circumferential surface thereon;

a continuous circumferential annular rim positioned around and coaxially with the hub, the annular rim having an interior circumferential surface;

a plurality of partitions extending between the hub and the annular rim, each of the partitions comprising:

a first radial section, a second radial section, an arcuate inner segment extending continuously between and integral with innermost ends of the first radial section and the second radial section, and an arcuate outer segment extending continuously between and integral with outermost ends of the first radial section and the second radial section, wherein the first radial section, the second radial section, the arcuate inner segment and the arcuate outer segment form a closed loop arc shaped modular unitary construction, each of the partitions being located in a predetermined circumferential position by at least one alignment feature, each partition touching an immediately adjacent partition on either side thereof to accommodate thermal expansion of adjacent partitions relative to one another;

a radially inward facing circumferential surface of the arcuate inner segment directly engaging the exterior circumferential surface and a radially outward facing circumferential surface of the arcuate outer segment engaging the interior circumferential surface; and at least one of the exterior circumferential surface, the interior circumferential surface and the partitions having at least one of the alignment features thereon, wherein at least one of the hub, the annular rim and at least one of the plurality of partitions consists of a ceramic material.

19. A rotor for a high temperature rotary pre-heater, the rotor comprising:

a hub having an exterior circumferential surface thereon;

a continuous circumferential annular rim positioned around and coaxially with the hub, the annular rim having an interior circumferential surface;

a plurality of partitions extending radially between the hub and the annular rim, each of the partitions located in a predetermined circumferential position and retained in the predetermined circumferential position by at least one alignment feature; and at least one of the exterior circumferential surface, the interior circumferential surface and the partitions having at least one of the alignment features thereon, wherein at least one of the partitions comprises a plurality of radially extending spokes having a first terminal end adjacent the external circumferential surface of the hub and extending to a second terminal end adjacent the interior circumferential surface of the annular rim;

at least one of the alignment features on the exterior circumferential surface of the hub comprises an axially extending first slot;

at least one of the alignment features on the interior circumferential surface of the annular rim comprises an axially extending second slot;

the first terminal end is seated in a respective one of the axially extending first slots and the second terminal end is seated in a corresponding respective one of the axially extending second slots; and a first ceramic fiber blanket disposed between at least one of:

the first terminal end and the respective one of the axially extending first slots; and the second terminal end and the respective one of the axially extending_second slots, wherein at least one of the hub, the annular rim and at least one of the plurality of partitions consists of a ceramic material.

* * * * *